US011721271B2

(12) United States Patent
Jeong et al.

(10) Patent No.: US 11,721,271 B2
(45) Date of Patent: Aug. 8, 2023

(54) DISPLAY DEVICE AND METHOD OF DRIVING THE SAME

(71) Applicant: Samsung Display Co., LTD., Yongin-si (KR)

(72) Inventors: Ji-Woong Jeong, Hwaseong-si (KR); Boyoung An, Hwaseong-si (KR); Kyoungho Lim, Hwaseong-si (KR)

(73) Assignee: Samsung Display CO., Ltd., Yongin-si (KR)

( * ) Notice: Subject to any disclaimer, the term of this patent is extended or adjusted under 35 U.S.C. 154(b) by 0 days.

(21) Appl. No.: 17/881,560

(22) Filed: Aug. 4, 2022

(65) Prior Publication Data

US 2023/0126636 A1 Apr. 27, 2023

(30) Foreign Application Priority Data

Oct. 22, 2021 (KR) ..... 10-2021-0141866

(51) Int. Cl.
*G09G 3/20* (2006.01)

(52) U.S. Cl.
CPC ... *G09G 3/2092* (2013.01); *G09G 2300/0452* (2013.01); *G09G 2310/027* (2013.01); *G09G 2320/0626* (2013.01)

(58) Field of Classification Search
CPC ..... G09G 3/2092; G09G 2300/0452; G09G 2310/027; G09G 2320/0626
See application file for complete search history.

(56) References Cited

U.S. PATENT DOCUMENTS

| | | | | |
|---|---|---|---|---|
| 9,224,332 | B2 | 12/2015 | Byun et al. | |
| 10,755,635 | B2 | 8/2020 | Yang et al. | |
| 2012/0019569 | A1* | 1/2012 | Byun | G09G 3/3233 345/77 |
| 2016/0351101 | A1* | 12/2016 | Lee | G09G 3/3225 |
| 2017/0213493 | A1* | 7/2017 | Han | G09G 3/3208 |
| 2018/0053462 | A1* | 2/2018 | Bae | G09G 3/2074 |
| 2019/0392777 | A1* | 12/2019 | Kim | G09G 3/3688 |
| 2020/0152136 | A1* | 5/2020 | Jeon | G09F 9/301 |
| 2020/0193885 | A1* | 6/2020 | Lee | G09G 3/3275 |

FOREIGN PATENT DOCUMENTS

| | | |
|---|---|---|
| KR | 10-2013-0036660 | 4/2013 |
| KR | 10-2017-0064179 | 6/2017 |

* cited by examiner

*Primary Examiner* — Jose R Soto Lopez
(74) *Attorney, Agent, or Firm* — H.C. Park & Associates, PLC

(57) ABSTRACT

A display device includes a display panel including pixels, and a driver to drive the display panel based on input image data. The driver performs a sensing operation for the pixels, to selectively perform the sensing operation by comparing grayscale values of the input image data and a reference grayscale value, to selectively perform a luminance control operation for controlling luminance of the display panel in response to a luminance control signal, and to adjust the reference grayscale value when the luminance control operation is performed.

20 Claims, 15 Drawing Sheets

| Hist section | start grayscale value | end grayscale value | PX |
|---|---|---|---|
| hist 15 | 240 | 255 | 4,147,200 |
| hist 14 | 192 | 239 | - |
| hist 13 | 160 | 191 | - |
| hist 12 | 128 | 159 | - |
| hist 11 | 112 | 127 | - |
| hist 10 | 96 | 111 | - |
| hist 09 | 80 | 95 | - |
| hist 08 | 64 | 79 | - |
| hist 07 | 48 | 63 | - |
| hist 06 | 40 | 47 | - |
| hist 05 | 32 | 39 | - |
| hist 04 | 24 | 31 | - |
| hist 03 | 16 | 23 | - |
| hist 02 | 9 | 15 | 4,147,200 |
| hist 01 | 1 | 8 | - |
| hist 00 | 0 | 0 | - |

FIG. 15G

FIG. 4

| Hist section | start grayscale value | end grayscale value | PX |
|---|---|---|---|
| hist 15 | 240 | 255 | 4,147,200 |
| hist 14 | 192 | 239 | - |
| hist 13 | 160 | 191 | - |
| hist 12 | 128 | 159 | - |
| hist 11 | 112 | 127 | - |
| hist 10 | 96 | 111 | - |
| hist 09 | 80 | 95 | - |
| hist 08 | 64 | 79 | - |
| hist 07 | 48 | 63 | - |
| hist 06 | 40 | 47 | - |
| hist 05 | 32 | 39 | - |
| hist 04 | 24 | 31 | - |
| hist 03 | 16 | 23 | - |
| hist 02 | 9 | 15 | 4,147,200 |
| hist 01 | 1 | 8 | - |
| hist 00 | 0 | 0 | - |

RG:15G

FIG. 6

| Hist section | start grayscale value | end grayscale value | PX |
|---|---|---|---|
| hist 15 | 240 | 255 | 4,147,200 |
| hist 14 | 192 | 239 | - |
| hist 13 | 160 | 191 | - |
| hist 12 | 128 | 159 | - |
| hist 11 | 112 | 127 | - |
| hist 10 | 96 | 111 | - |
| hist 09 | 80 | 95 | - |
| hist 08 | 64 | 79 | - |
| hist 07 | 48 | 63 | - |
| hist 06 | 40 | 47 | - |
| hist 05 | 32 | 39 | - |
| hist 04 | 24 | 31 | - |
| hist 03 | 16 | 23 | - |
| hist 02 | 9 | 15 | 4,147,200 |
| hist 01 | 1 | 8 | - |
| hist 00 | 0 | 0 | - |

RG:15G

FIG. 10

| Hist section | start grayscale value | end grayscale value | PX |
|---|---|---|---|
| hist 15 | 240 | 255 | 4,147,200 |
| hist 14 | 192 | 239 | – |
| hist 13 | 160 | 191 | – |
| hist 12 | 128 | 159 | – |
| hist 11 | 112 | 127 | – |
| hist 10 | 96 | 111 | – |
| hist 09 | 80 | 95 | – |
| hist 08 | 64 | 79 | – |
| hist 07 | 48 | 63 | – |
| hist 06 | 40 | 47 | – |
| hist 05 | 32 | 39 | – |
| hist 04 | 24 | 31 | – |
| hist 03 | 16 | 23 | 2,073,600 |
| hist 02 | 9 | 15 | 2,073,600 |
| hist 01 | 1 | 8 | – |
| hist 00 | 0 | 0 | – |

RG:15G RG':23G

DISPLAY DEVICE AND METHOD OF DRIVING THE SAME

PRIORITY STATEMENT

This application claims priority from and the benefit of Korean Patent Application No. 10-2021-0141866, filed on Oct. 22, 2021, which is hereby incorporated by reference for all purposes as if fully set forth herein.

BACKGROUND

Field

Embodiments of the invention relate generally to display devices and, more specifically, to a display device capable of performing a sensing operation.

Discussion of the Background

Generally, a display device may include a display panel, a driving controller, gate driver, and a data driver. The display panel may include a plurality of gate lines, a plurality of data lines, and a plurality of pixels electrically connected to the gate lines and the data lines. The gate driver may provide gate signals to the gate lines. The data driver may provide data voltages to the data lines. The driving controller may control the gate driver and the data driver.

Each of driving transistors of the pixels has an electrical characteristic such as a threshold voltage and a mobility. The electrical characteristics of the driving transistors may be different for different pixels due to process variation, deterioration, and the like. Such a deviation in the electrical characteristics of the driving transistors may cause a luminance deviation and the luminance deviation may cause image quality deterioration.

To compensate for this difference in the electrical characteristics such as the threshold voltage and the mobility of the driving transistors, the display device may perform a sensing operation for sensing the electrical characteristics such as the threshold voltage and the mobility of the driving transistor of each of the pixels.

The above information disclosed in this Background section is only for understanding of the background of the inventive concepts, and, therefore, it may contain information that does not constitute prior art.

SUMMARY

Applicant realized that when the above-mentioned sensing operation is performed while the display device is powered on, horizontal lines (i.e., pixels on which the sensing operation is performed) may be visually recognized on the display panel due to the sensing operation, thereby adversely affecting display quality and/or the user experience.

Display devices constructed according to the principles and illustrative embodiments of the invention are capable of selectively performing a sensing operation according to grayscale values of input image data without adversely affecting the quality or performance of the display.

For example, display devices constructed according to the principles and illustrative embodiments of the invention may reduce or prevent a line (or region) on which a sensing operation is performed from being visually recognized by stopping the sensing operation when grayscale values of the input image data include grayscale values less than or equal to a reference grayscale value by a certain ratio or more.

Further, display devices constructed according to the principles and illustrative embodiments of the invention may effectively reduce or prevent a line (or region) on which a sensing operation is performed from being visually recognized regardless of a luminance control operation by adjusting a reference grayscale value when the luminance control operation is performed.

In addition, display devices constructed according to the principles and illustrative embodiments of the invention may effectively reduce or prevent a line (or region) on which a sensing operation is performed from being visually recognized regardless of the temperature of the display panel by adjusting a reference grayscale value based on the temperature of the display panel.

Additional features of the inventive concepts will be set forth in the description which follows, and in part will be apparent from the description, or may be learned by practice of the inventive concepts.

According to one aspect of the invention, a display device includes a display panel including pixels, and a driver to drive the display panel based on input image data, to selectively perform a sensing operation for the pixels by comparing grayscale values of the input image data and a reference grayscale value, to selectively perform a luminance control operation for controlling luminance of the display panel in response to a luminance control signal, and to adjust the reference grayscale value when the luminance control operation is performed.

The driver may perform the sensing operation by generating sensing data corresponding to a driving current of a driving transistor of each of the pixels in a vertical blank period.

The driver may not perform the sensing operation when a ratio of a number of the grayscale values of the input image data less than or equal to the reference grayscale value to a number of all of the grayscale values of the input image data is greater than or equal to a first reference value.

The driver may be configured to generate a histogram of the grayscale values of the input image data, and to compare the grayscale values of the input image data and the reference grayscale value based on the histogram.

The driver may not perform the sensing operation when a ratio of a number of the grayscale values of the input image data less than or equal to the reference grayscale value to a number of all of the grayscale values of the input image data is greater than or equal to a first reference value and is less than or equal to a second reference value greater than the first reference value.

The driver may not perform the sensing operation when a ratio of a number of the grayscale values less than or equal to the reference grayscale value except for a 0-grayscale value to a number of all of the grayscale values of the input image data is greater than or equal to a first reference value.

The driver may not perform the sensing operation when a ratio of a number of the grayscale values of the input image data less than or equal to the reference grayscale value except for a 0-grayscale value to a number of all of the grayscale values of the input image data is greater than or equal to a first reference value and is less than or equal to a second reference value greater than the first reference value.

The pixels may include red pixels, blue pixels, and green pixels. The driver may not perform the sensing operation when a ratio of a number of the grayscale values of the input image data for the red pixels less than or equal to the reference grayscale value to a number of all of the grayscale values of the input image data for the red pixels is greater than or equal to a first reference value. The driver may not perform the sensing operation when a ratio of a number of the grayscale values of the input image data for the blue pixels less than or equal to the reference grayscale value to a number of all of the grayscale values of the input image data for the blue pixels is greater than or equal to a first reference value. The driver may not perform the sensing operation when a ratio of a number of the grayscale values of the input image data for the green pixels less than or equal to the reference grayscale value to a number of all of the grayscale values of the input image data for the green pixels is greater than or equal to a first reference value.

The driver may be configured to perform the luminance control operation by applying a scale factor to the input image data.

The driver may be configured to adjust the reference grayscale value based on the scale factor.

The scale factor may be greater than about 0 and less than about 1. The driver may be configured to adjust the reference grayscale value by increasing the reference grayscale value as the scale factor increases.

The driver may be configured to adjust the reference grayscale value to a threshold grayscale value when the reference grayscale value adjusted based on the scale factor is greater than the threshold grayscale value.

According to another aspect of the invention, a display device includes a display panel including pixels and a driver configured to drive the display panel based on input image data. The driver is configured to selectively perform the sensing operation by comparing grayscale values of the input image data and a reference grayscale value, and to adjust the reference grayscale value based on a temperature of the display panel.

The driver may be configured to adjust the reference grayscale value by decreasing the reference grayscale value as the temperature of the display panel increases.

The driver may not perform the sensing operation when a ratio of a number of the grayscale values of the input image data less than or equal to the reference grayscale value to a number of all of the grayscale values of the input image data is greater than or equal to a first reference value.

The driver may be configured to generate a histogram of the grayscale values of the input image data, and to compare the grayscale values of the input image data and the reference grayscale value based on the histogram.

The driver may be configured to selectively perform a luminance control operation for controlling luminance of the display panel in response to a luminance control signal, and to adjust the reference grayscale value when the luminance control operation is performed.

The driver may be configured to perform the luminance control operation by applying a scale factor to the input image data.

The driver may be configured to adjust the reference grayscale value based on the scale factor.

The scale factor may be greater than about 0 and less than about 1. The driver may be configured to adjust the reference grayscale value by increasing the reference grayscale value as the scale factor increases.

According to another aspect of the invention, a method of driving a display device includes selectively performing a sensing operation for pixels included in a display panel by comparing grayscale values of an input image data and a reference grayscale value, selectively performing a luminance control operation for controlling luminance of the display panel in response to a luminance control signal, and adjusting the reference grayscale value when the luminance control operation is performed.

It is to be understood that both the foregoing general description and the following detailed description are illustrative and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate illustrative embodiments of the invention, and together with the description serve to explain the inventive concepts.

FIG. 4 is a table of a histogram of grayscale values of the input image data of FIG. 3 generated by the display device of FIG. 1.

FIG. 6 is a table of another example of a histogram of grayscale values of the input image data of FIG. 3 generated by the display device of FIG. 1.

FIG. 10 is a table of another example of a histogram of the display device of FIG. 1.

DETAILED DESCRIPTION

Figure 1:
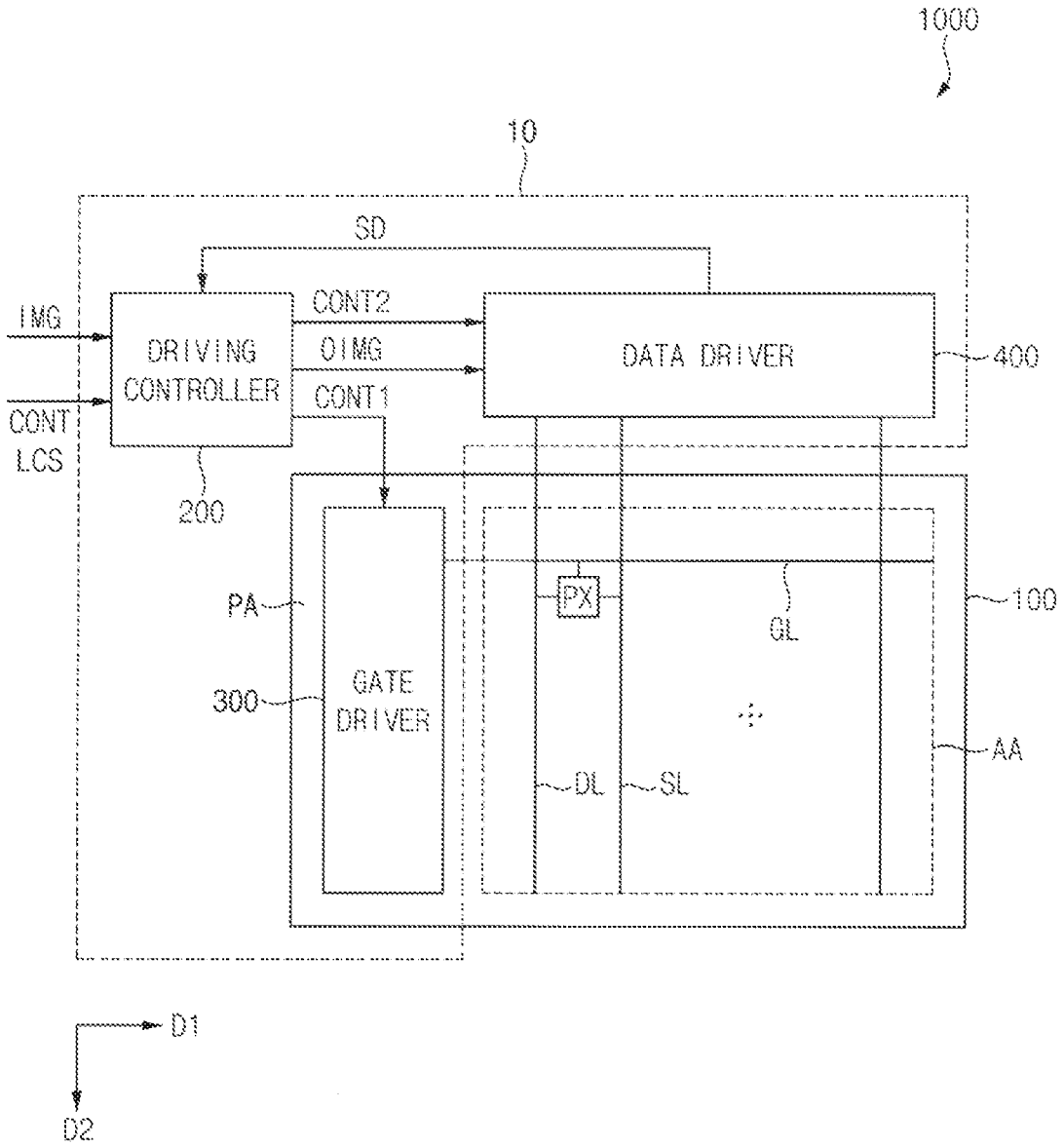
FIG. 1 is a block diagram of an embodiment of a display device constructed according to the principles of the invention.

In the following description, for the purposes of explanation, numerous specific details are set forth in order to provide a thorough understanding of various embodiments or implementations of the invention. As used herein "embodiments" and "implementations" are interchangeable words that are non-limiting examples of devices or methods employing one or more of the inventive concepts disclosed herein. It is apparent, however, that various embodiments may be practiced without these specific details or with one or more equivalent arrangements. In other instances, well-known structures and devices are shown in block diagram form in order to avoid unnecessarily obscuring various embodiments. Further, various embodiments may be different, but do not have to be exclusive. For example, specific shapes, configurations, and characteristics of an embodiment may be used or implemented in another embodiment without departing from the inventive concepts.

Unless otherwise specified, the illustrated embodiments are to be understood as providing illustrative features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some embodiments may be physically separated into two or more interacting and discrete blocks, units, and/or modules without departing from the scope of the inventive concepts. Further, the blocks, units, and/or modules of some embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a block diagram of an embodiment of a display device 1000 constructed according to the principles of the invention.

Referring to FIG. 1, the display device 1000 may include a display panel 100 and a driver that may be in the form of a display panel driver 10. The display panel driver 10 may drive the display panel 100 based on input image data IMG including a driving controller 200, a gate driver 300, and a data driver 400. The driving controller 200 and the data driver 400 may be integrated into one chip.

The display panel 100 has a display region AA on which an image is displayed and a peripheral region PA adjacent to the display region AA. The gate driver 300 may be integrated on the peripheral region PA of the display panel 100.

The display panel 100 may include a plurality of gate lines GL, a plurality of data lines DL, a plurality of sensing lines SL, and a plurality of pixels Px electrically connected to the data lines DL, the gate lines GL, and the sensing lines SL. The gate lines GL may extend in a first direction D1 and the data lines DL and the sensing lines SL may extend in a second direction D2 intersecting the first direction D1.

The driving controller 200 may receive input image data IMG, an input control signal CONT, and a luminance control signal LCS from a host processor (e.g., a graphic processing unit; GPU). For example, the input image data IMG may include red image data, green image data and blue image data. The input image data IMG may further include white image data. For another example, the input image data IMG may include magenta image data, yellow image data, and cyan image data. The input control signal CONT may include a master clock signal and a data enable signal. The input control signal CONT may further include a vertical synchronizing signal and a horizontal synchronizing signal. The driving controller 200 may receive sensing data SD from the data driver 400. A detailed description of the sensing data SD is described below.

The driving controller 200 may selectively perform a luminance control operation for controlling a luminance of the display panel 100 in response to the luminance control signal LCS. The driving controller 200 may perform the luminance control operation when the luminance control signal LCS is activated. For example, when the input image data IMG is a still image, the luminance control signal LCS may be activated, and the driving controller 200 may decrease the luminance of the display panel 100. The driving controller 200 may generate the luminance control signal LCS by itself without receiving the luminance control signal LCS from the host processor. The driving controller 200 may generate the luminance control signal LCS based on the input image data IMG. For example, when the load of the input image data IMG becomes a predetermined value or more, the luminance control signal LCS is activated, and the driving controller 200 may reduce the luminance of the display panel 100. Accordingly, the driving controller 200 may reduce power consumption by performing the luminance control operation.

The driving controller 200 may generate a first control signal CONT1, a second control signal CONT2, and output image data OIMG based on the input image data IMG, the sensing data SD, the luminance control signal LCS, and the input control signal CONT.

The driving controller 200 may generate the first control signal CONT1 for controlling operation of the gate driver 300 based on the input control signal CONT and output the first control signal CONT1 to the gate driver 300. The first control signal CONT1 may include a vertical start signal and a gate clock signal.

The driving controller 200 may generate the second control signal CONT2 for controlling operation of the data driver 400 based on the input control signal CONT and output the second control signal CONT2 to the data driver 400. The second control signal CONT2 may include a horizontal start signal and a load signal.

The driving controller 200 may receive the input image data IMG, the sensing data SD, and the input control signal CONT, and generate the output image data OIMG. The driving controller 200 may output the output image data OIMG to the data driver 400.

The gate driver 300 may generate gate signals for driving the gate lines GL in response to the first control signal CONT1 input from the driving controller 200. The gate driver 300 may output the gate signals to the gate lines GL. For example, the gate driver 300 may sequentially output the gate signals to the gate lines GL.

The data driver 400 may receive the second control signal CONT2 and the output image data OIMG from the driving controller 200. The data driver 400 may convert the output image data OIMG into data voltages having an analog type. The data driver 400 may output the data voltage to the data lines DL. The data driver 400 may generate the sensing data SD corresponding to a driving current of a driving transistor of each of the pixels Px. A detailed description thereof appears below.

Figure 2:
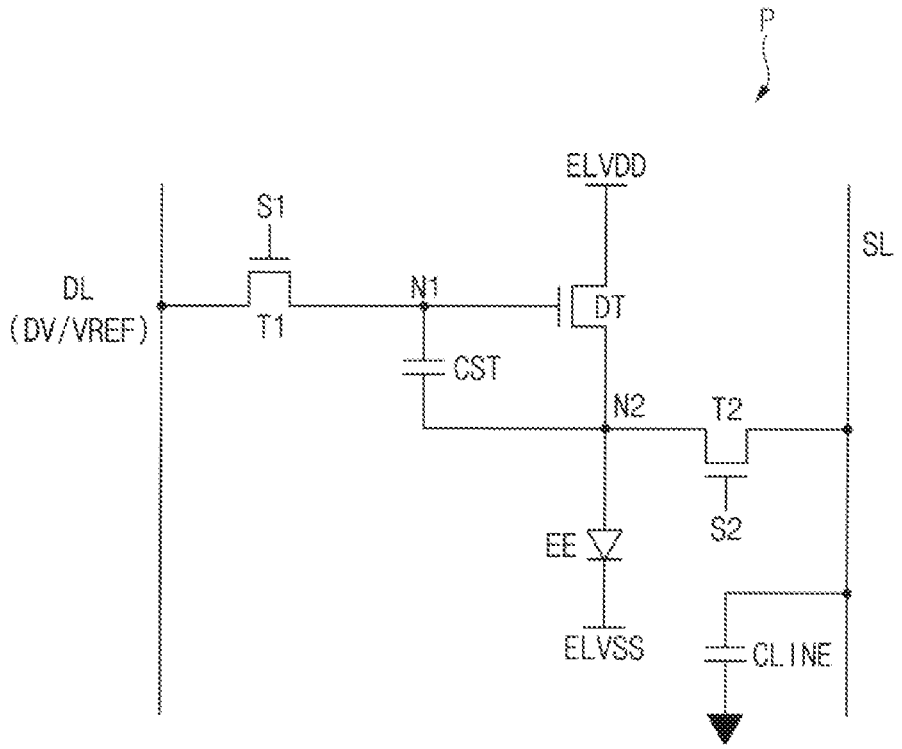
FIG. 2 is a circuit diagram of a representative pixel of the display device of FIG. 1.

FIG. 2 is a circuit diagram of an example of the pixels Px of the display device 1000 of FIG. 1.

Referring to FIGS. 1 and 2, each of the pixels Px may include a first switching transistor T1 configured to applying the data voltage DV (e.g., a reference voltage VREF) to a control electrode (i.e., a first node N1) of the driving transistor DT, a storage capacitor CST configured to store the data voltage DV (e.g., the reference voltage VREF), the driving transistor DT configure to generate the driving current in response to the data voltage DV (e.g., the reference voltage VREF), a light emitting element configured to emit light based on the driving current, and a second switching transistor T2 configured to control the flow of the driving current to the sensing line SL in response to a second gate signal S1. A sensing capacitor CLINE may be connected to the sensing lines SL.

For example, the first switching transistor T1 may include the control electrode configured to receive a first gate signal S1, an input electrode connected to the data line DL, and an output electrode connected to the first node N1, the storage capacitor CST may include a first electrode connected to the first node N1 and a second electrode connected to a second node N2, the driving transistor DT may include the control electrode connected to the first node N1, an input electrode configured to receive a first power voltage ELVDD, and an output electrode connected to the second node N2, the second switching transistor T2 may include a control electrode configured to receive the second gate signal S2, an input electrode connected to the second node N2, and an output electrode connected to the sensing line SL, and the light emitting element EE may include a first electrode connected to the second node N2 and a second electrode configured to receive a second power voltage ELVSS.

Each frame may include an active period and a vertical blank period. The data driver 400 may sequentially apply the data voltage DV to the pixels Px through the data lines DL in the active period of each frame, and may apply the reference voltage VREF for sensing operation to the pixels Px through the data lines DL in the vertical blank period of each frame.

The display panel driver 10 may perform the sensing operation on the pixels Px. The display panel driver 10 may perform the sensing operation by generating the sensing data SD corresponding to the driving current of the driving transistor DT of each of the pixels Px. For example, the data driver 400 may apply the reference voltage VREF to the pixels Px, receive the driving current of the driving transistor DT each of the pixels Px, and generate the sensing data SD corresponding to the driving current. Also, the driving controller 200 may calculate mobility of the driving transistor DT of each of the pixels Px based on the sensing data SD. For example, in the sensing operation, the sensing data SD is generated by applying the reference voltage VREF to the pixels Px, and the mobility of the driving transistor DT of each of the pixels Px is sensed based on the sensing data SD. The display panel driver 10 may perform the sensing operation on one pixel row for every frame. The display panel driver 10 may perform the sensing operation on one pixel row for every frame, and the pixel row on which the sensing operation is performed may be randomly selected.

The driving controller 200 may compensate the input image data IMG based on the mobility of the driving transistor DT of each of the pixels Px. In the display device 1000, differences in characteristics of the pixels Px, e.g., the threshold voltage and the mobility of the driving transistor DT, may occur due to a process deviation or the like. To compensate for the differences, the display device 1000 may sense the threshold voltage and/or the mobility of the driving transistor DT of each of the pixels Px, and may compensate the data voltage DV applied to each of the pixels Px based on the threshold voltage and/or mobility. For example, the input image data IMG may be compensated or modified to prevent or minimize the differences in the characteristics of the pixels Px. The display quality of the display device 1000 may be improved by the sensing operation.

In the vertical blank period, the data driver 400 may perform the sensing operation by applying the reference voltage VREF to the pixels Px, and then apply the data voltage DV applied before the reference voltage VREF is applied to the pixels Px to which the reference voltage VREF is applied (hereinafter, referred to as a 'rewriting operation'). For example, by returning the driving current of the pixels Px to which the reference voltage VREF is applied for the sensing operation to before the reference voltage VREF is applied, a previously displayed image may be displayed to the pixels Px to which the reference voltage VREF is applied. However, the driving current of the pixels Px may decrease over time due to current leakage occurring in the first electrode of the light emitting element EE. Accordingly, when the rewriting operation is performed, a difference in luminance may be generated between the pixels Px on which the rewriting operation is performed and the neighboring pixels Px of the pixels Px on which the rewriting operation is performed. For example, assuming that the driving current for displaying a 255-grayscale value is 10A, the driving current of the pixels Px on which the rewriting operation is not performed during the vertical blank period (i.e., the pixels Px on which the sensing operation is not performed in the corresponding frame) may gradually decrease from 10A or less, and the driving current of the pixels Px on which the rewriting operation is performed (i.e., the pixels Px on which the sensing operation is performed in the corresponding frame) may be 10A when the rewriting operation is performed. Accordingly, the luminance difference is generated between the pixels Px on which the sensing operation is performed and the pixels Px on which the sensing operation is not performed, and a line (or region) on which the sensing operation is performed is visually recognized on the display panel 100 due to the luminance difference (hereinafter, referred to as a 'sensing recognition phenomenon'). The sensing recognition phenomenon may be difficult to detect when the display panel driver 10 randomly selects the pixel row on which the sensing operation is performed. But, the sensing recognition phenomenon may be more easily recognized in a low brightness image (i.e., low grayscale value image) than in a high brightness image (i.e., high grayscale value image) because the human eye can more readily distinguish differences in dark places than in bright places.

Figure 3:
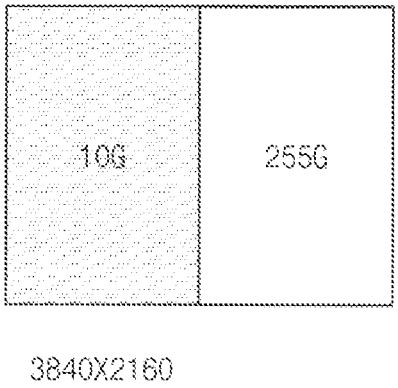
FIG. 3 is a diagram illustrating an example of input image data displayed on a display panel of the display device of FIG. 1.
Figure 5:
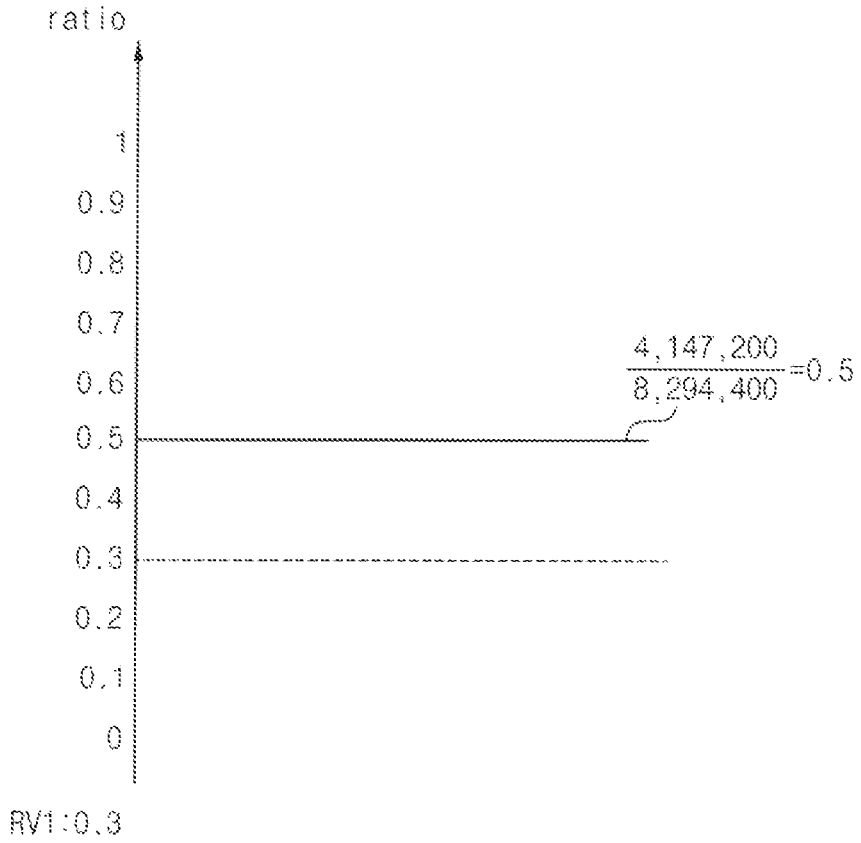
FIG. 5 is a graph illustrating an example in which the display device of FIG. 1 determines whether or not to perform a sensing operation.

FIG. 3 is a diagram illustrating an example of the input image data IMG displayed on the display panel 100 of the display device 1000 of FIG. 1, FIG. 4 is a table of a histogram of grayscale values of the input image data IMG of FIG. 3 generated by the display device 1000 of FIG. 1, FIG. 5 is a graph illustrating an example in which the display device 1000 of FIG. 1 determines whether or not to perform the sensing operation. FIG. 4 represents a histogram section (hist00, hist01, and hist02) in which grayscale values smaller than or equal to a reference grayscale value RG are included.

Referring to FIGS. 1 to 5, the display panel driver 10 may selectively perform the sensing operation by comparing the grayscale values of the input image data IMG and the reference grayscale value RG. The display panel driver 10 may generate the histogram of the grayscale values of the input image data IMG, and compare the grayscale values of the input image data IMG and the reference grayscale value RG based on the histogram. The display panel driver 10 may not perform the sensing operation when a ratio of the number of the grayscale values of the input image data IMG less than or equal to the reference grayscale value RG to a number of all of the grayscale values of the input image data IMG is greater than or equal to a first reference value RV1. The reference grayscale value RG may be a grayscale value in which the sensing recognition phenomenon occurs prominently. The first reference value RV1 may be a ratio of the number of the grayscale values of the input image data IMG that are less than or equal to the reference grayscale value RG in which the sensing recognition phenomenon occurs prominently.

For example, as shown in FIGS. 3, 4, and 5, it is assumed that half of the input image data IMG includes a 10-grayscale value 10G, the other half includes the 255-grayscale value 255G, a resolution is 3840×2160, and the reference grayscale value RG is a 15-grayscale value 15G, and the first reference value RV1 is 0.3. For example, as shown in FIG. 4, the histogram is divided into 15 sections (hist00, hist01, . . . , and hist15), and each section (hist00, hist01, . . . , and hist15) includes the number of the pixels Px for displaying the grayscale values between a start grayscale value and an end grayscale value. Since the resolution is 3840×2160, the total number of the pixels Px is 8,294,400. For example, the number of the pixels Px for displaying the 10-grayscale value 10G is 4,147,200, and the number of the pixels Px for displaying the 255-grayscale value 255G is 4,147,200. As shown in FIG. 4, the pixels Px for displaying grayscale values smaller than or equal to the reference grayscale value RG are included in the hist00, hist01, and hist02 sections, and the 10-grayscale value 10G are included in the hist02 section. Therefore, the number of the pixels Px for displaying the grayscale values smaller than or equal to the reference grayscale value RG is 4,147,200. The ratio of the number of the grayscale values of the input image data IMG less than or equal to the reference grayscale value RG to the number of all of the grayscale values of the input image data IMG may be calculated by dividing the number of the pixels for displaying the grayscale values smaller than or equal to the reference grayscale value RG by the total number of the pixels Px. Accordingly, the ratio of the number of the grayscale values of the input image data IMG less than or equal to the reference grayscale value RG is 4,147,200÷8,294,400=0.5. Further, since 0.5 is greater than the first reference value RV1, the display panel driver 10 may not perform the sensing operation. As such, the display panel driver 10 may stop the sensing operation when displaying an image based on the input image data IMG having a large ratio of low grayscale value (e.g., grayscale values less than or equal to the reference grayscale value RG). So, the display panel driver 10 may reduce or prevent the sensing recognition phenomenon.

FIG. 6 is a table of another example of the histogram of the grayscale values of the input image data IMG of FIG. 3 generated by the display device. FIG. 6 represents a histogram section (hist01 and hist02) in which grayscale values smaller than or equal to a reference grayscale value RG except for 0 grayscale value are included.

The display device according to this embodiment is substantially the same as the display device 1000 of FIG. 1 except for excepting for 0 grayscale value. Thus, the same reference numerals are used to refer to the same or similar element, and any repetitive description is omitted to avoid redundancy.

Referring to FIGS. 3 and 6, the display panel driver 10 may not perform the sensing operation when a ratio of the number of the grayscale values of the input image data IMG less than or equal to the reference grayscale value RG except for 0 grayscale value to the number of all of the grayscale values of the input image data IMG is greater than or equal to the first reference value RV1. When the display device 1000 displays an image only on a part of the display panel 100 (e.g., a pattern for testing the display panel 100), 0 grayscale value may be displayed in a remaining region except for the part where the image is displayed. In this case, the ratio of the number of the grayscale values of the input image data IMG less than or equal to the reference grayscale value RG to the number of all of the grayscale values of the input image data IMG is greater than the first reference value RV1, and the sensing operation may not be continuously performed. However, since the sensing operation may be performed in a pattern for displaying an image repeatedly displayed on only a part of the display panel, the display panel driver 10 may determine whether to perform the sensing operation except for 0 grayscale value when the pattern for displaying the image is repeatedly displayed on only the part of the display panel 100.

For example, as shown in FIGS. 3 and 6, it is assumed that half of the input image data IMG includes the 10-grayscale value 10G, the other half includes the 255-grayscale value 255G, a resolution is 3840×2160, the reference grayscale value RG is the 15-grayscale value 15G, and the first reference value RV1 is 0.3. For example, as shown in FIG. 6, the histogram is divided into 15 sections (hist00, hist01, . . . , and hist15), and each section (hist00, hist01, . . . , and hist15) includes the number of the pixels Px for displaying grayscale values between the start grayscale value and the end grayscale value. Since the resolution is 3840×2160, the total number of the pixels Px is 8,294,400. Of the 8,294,400 pixels Px, the number of the pixels Px for displaying the 10-grayscale value 10G is 4,147,200, and the number of the pixels Px for displaying the 255-grayscale value 255G is 4,147,200. As shown in FIG. 6, the pixels Px for displaying the grayscale values smaller than or equal to the reference grayscale value RG excepting for 0 grayscale value are included in the hist01, and hist02 sections, and the 10-grayscale value 10G are included in the hist02 section. Therefore, the number of the pixels Px for displaying the grayscale values smaller than or equal to the reference grayscale value RG excepting for 0 grayscale value is 4,147,200. The ratio of the number of the grayscale values of the input image data IMG less than or equal to the reference grayscale value RG excepting for 0 grayscale value to the number of all of the grayscale values of the input image data IMG may be calculated by dividing the number of the pixels for displaying the grayscale values smaller than or equal to the reference grayscale value RG excepting for 0 grayscale value by the total number of the pixels Px. Accordingly, the ratio of the number of the grayscale values of the input image data IMG less than or equal to the reference grayscale value RG excepting for 0 grayscale value is 4,147,200÷8,294,400=0.5. And, since 0.5 is greater than the first reference value RV1, the display panel driver 10 may not perform the sensing operation. As such, the display panel driver 10 may stop the sensing operation when displaying an image based on the input image data IMG having a large ratio of low grayscale value (e.g., grayscale values less than or equal to the reference grayscale value RG). So, the display panel driver 10 may reduce or prevent the sensing recognition phenomenon.

Figure 7:
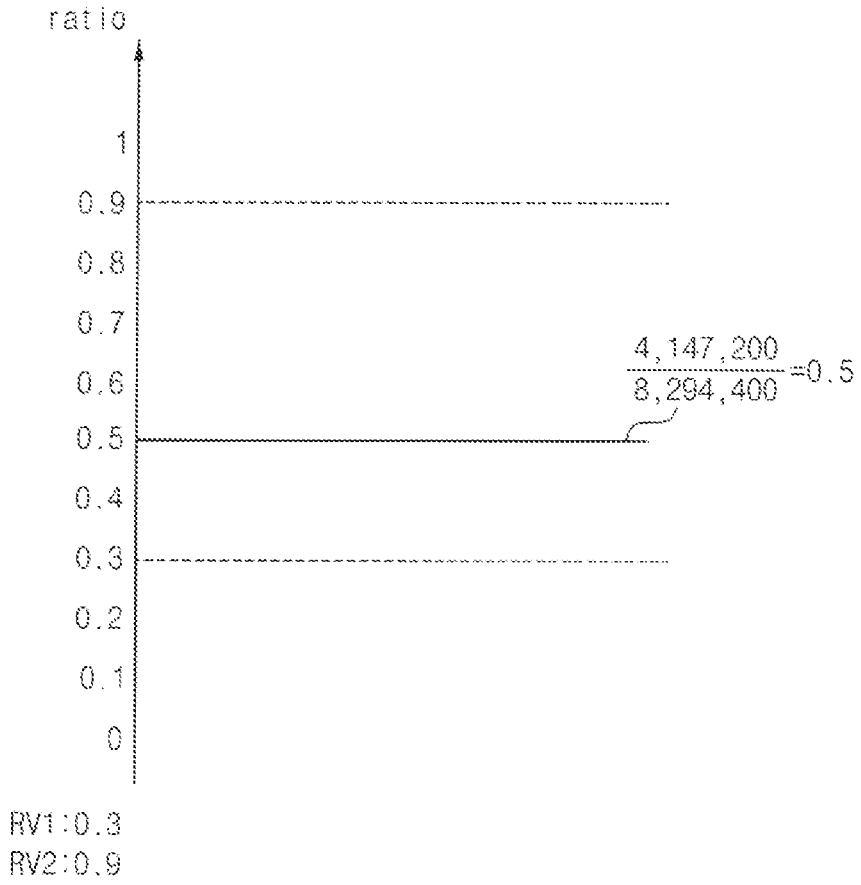
FIG. 7 is a graph illustrating another example in which the display device of FIG. 1 determines whether or not to perform a sensing operation.

FIG. 7 is a graph illustrating another example in which the display device of FIG. 1 determines whether or not to perform a sensing operation.

The display device according to this embodiment is substantially the same as the display device 1000 of FIG. 1 except for determining whether to perform the sensing operation. Thus, the same reference numerals are used to refer to the same or similar element, and any repetitive description is omitted to avoid redundancy.

Referring to FIGS. 1 to 4, and 7, the display panel driver 10 may not perform the sensing operation when a ratio of the number of the grayscale values of the input image data IMG less than or equal to the reference grayscale value RG to the number of all of the grayscale values of the input image data IMG is greater than or equal to the first reference value RV1 and is less than or equal to a second reference value RV2 greater than the first reference value RV1. The reference grayscale value RG may be a grayscale value in which the sensing recognition phenomenon occurs prominently. The first reference value RV1 may be a ratio of the number of the grayscale values of the input image data less than or equal to the reference grayscale value RG in which the sensing recognition phenomenon occur prominently. When the display device 1000 displays an image only on a part of the display panel 100, 0 grayscale value may be displayed in a remaining region except for the part where the image is displayed. In this case, the ratio of the number of the grayscale values of the input image data IMG less than or equal to the reference grayscale value RG to the number of all of the grayscale values of the input image data IMG is greater than the first reference value RV1, and the sensing operation may not be continuously performed. However, since the sensing operation may be performed in a pattern for displaying an image repeatedly displayed on only a part of the display panel, the display panel driver 10 may perform the sensing operation when the ratio of the number of the grayscale values of the input image data IMG less than or equal to the reference grayscale value RG to the number of all of the grayscale values of the input image data IMG is greater than the second reference value RV2.

For example, as shown in FIGS. 3, 4 and 7, it is assumed that half of the input image data IMG includes the 10-grayscale value 10G, the other half includes the 255-grayscale value 255G, a resolution is 3840×2160, the reference grayscale value RG is the 15-grayscale value 15G, the first reference value RV1 is 0.3, and the second reference value RV2 is 0.9. For example, as shown in FIG. 6, the histogram is divided into 15 sections (hist00, hist01, . . . , and hist15), and each section (hist00, hist01, . . . , and hist15) includes the number of the pixels Px for displaying grayscale values between the start grayscale value and the end grayscale value. Since the resolution is 3840×2160, the total number of the pixels Px is 8,294,400. For example, the number of the pixels Px for displaying the 10-grayscale value 10G is 4,147,200, and the number of the pixels Px for displaying the 255-grayscale value 255G is 4,147,200. As shown in FIG. 4, the pixels Px for displaying the grayscale values smaller than or equal to the reference grayscale value RG are included in the hist00, hist01, and hist02 sections, and the 10-grayscale value 10G are included in the hist02 section. Therefore, the number of the pixels Px for displaying the grayscale values smaller than or equal to the reference grayscale value RG grayscale value is 4,147,200. The ratio of the number of the grayscale values of the input image data IMG than or equal to the reference grayscale value RG to the number of all of the grayscale values of the input image data IMG may be calculated by dividing the number of the pixels for displaying the grayscale values smaller than or equal to the reference grayscale value RG by the total number of the pixels Px. Accordingly, the ratio of the number of the grayscale values of the input image data IMG less than or equal to the reference grayscale value RG is 4,147,200÷8,294,400=0.5. And, since 0.5 is greater than the first reference value RV1 and is less than the second reference value RV2, the display panel driver 10 may not perform the sensing operation.

Figure 8:
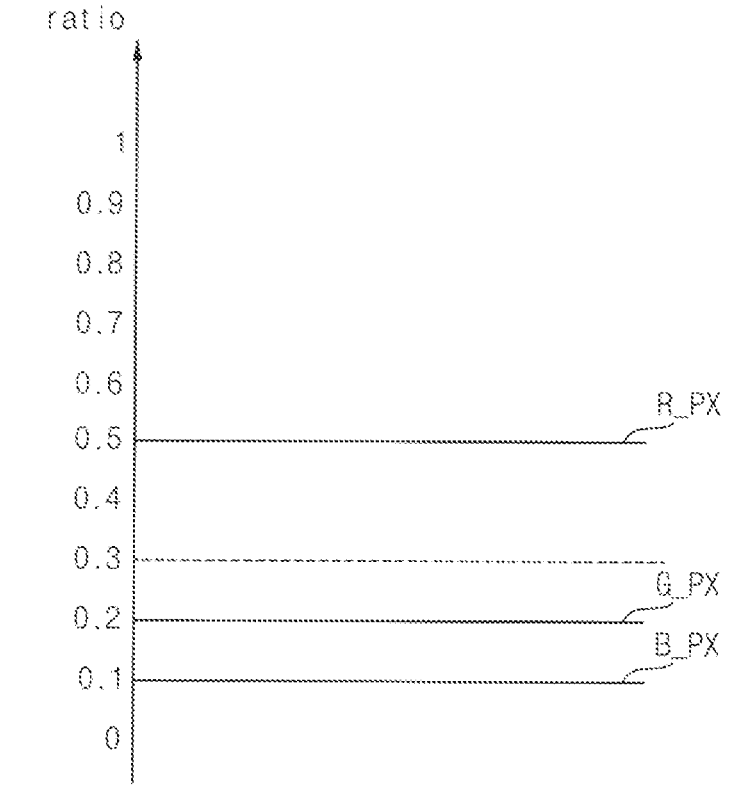
FIG. 8 is a table of another example in which the display device of FIG. 1 determines whether or not to perform a sensing operation.

FIG. 8 is a table of another example in which the display device of FIG. 1 determines whether to perform the sensing operation.

The display device according to this embodiment is substantially the same as the display device 1000 of FIG. 1 except for determining whether to perform the sensing operation. Thus, the same reference numerals are used to refer to the same or similar element, and any repetitive description is omitted to avoid redundancy.

Referring to FIGS. 1 to 3, and 8, each of the pixels Px may include red pixels R_Px, blue pixels B_Px, and green pixels G_Px. The display panel driver 10 may not perform the sensing operation when a ratio of the number of grayscale values of the input image data IMG for the red pixels R_Px less than or equal to the reference grayscale value RG to the number of all of the grayscale values of the input image data IMG for the red pixels R_Px is greater than or equal to the first reference value RV1, may not perform the sensing operation when a ratio of the number of the grayscale values of the input image data IMG for the blue pixels B_Px less than or equal to the reference grayscale value RG to the number of all of the grayscale values of the input image data IMG for the blue pixels B_Px is greater than or equal to the first reference value RV1, and may not perform the sensing operation when a ratio of the number of the grayscale values of the input image data IMG for the green pixels G_Px less than or equal to the reference grayscale value RG to the number of all of the grayscale values of the input image data IMG for the green pixels G_Px is greater than or equal to the first reference value RV1.

For example, assuming that a ratio of the number of the grayscale values of the input image data IMG for the data voltage DV applied to the red pixels R_Px less than or equal to the reference grayscale value RG to the number of all of the grayscale values of the input image data IMG for the data voltage DV applied to the red pixels R_Px is 0.5, a ratio of the number of the grayscale values of the input image data IMG for the data voltage DV applied to the blue pixels B_Px less than or equal to the reference grayscale value RG to the number of all of the grayscale values of the input image data IMG for the data voltage DV applied to the blue pixels B_Px is 0.1, a ratio of the number of the grayscale values of the input image data IMG for the data voltage DV applied to the green pixels G_Px which is less than or equal to the reference grayscale value RG to the grayscale values of the input image data IMG for the data voltage DV applied to the green pixels G_Px is 0.2, and the first reference value RV1 is 0.3, since there is one ratio greater than or equal to the first reference value RV1, the display panel driver 10 may not perform the sensing operation.

Figure 9:
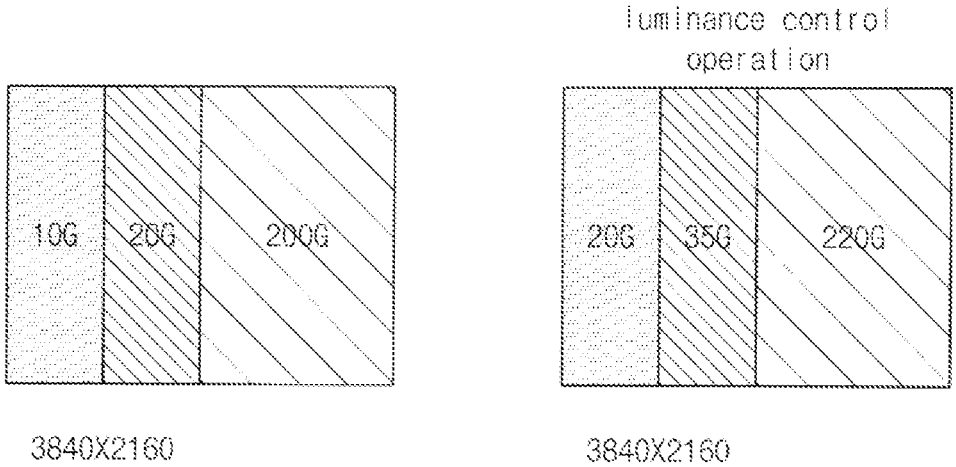
FIG. 9 is a diagram for explaining a luminance control operation of the display device of FIG. 1.
Figure 11:
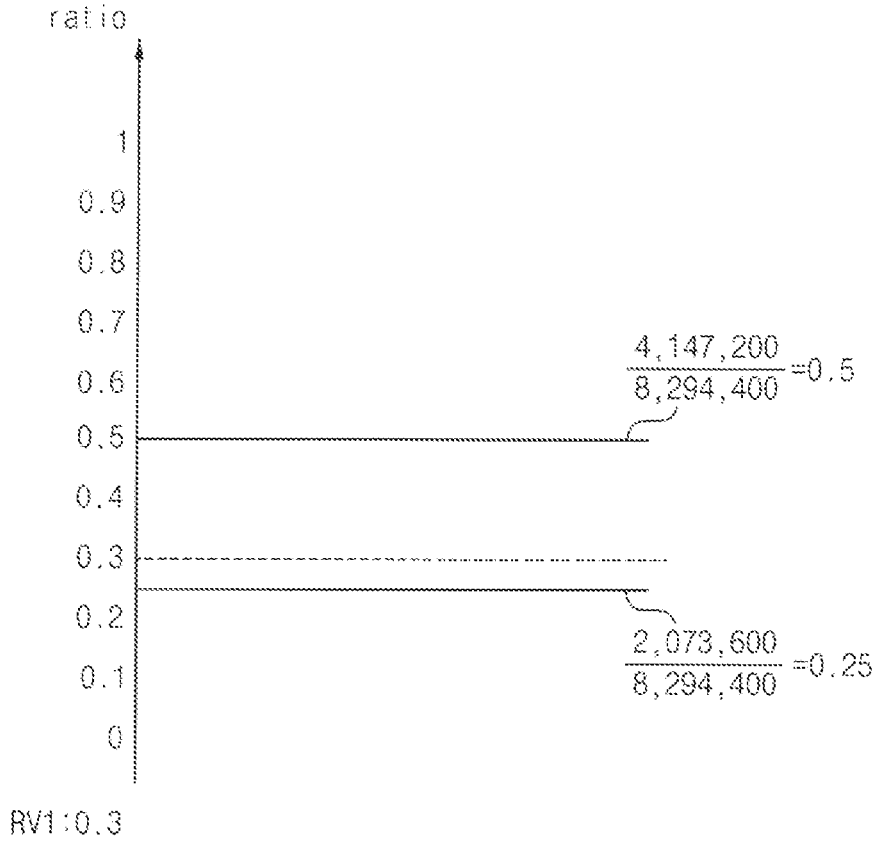
FIG. 11 is a graph illustrating another example in which the display device of FIG. 1 determines whether or not to perform a sensing operation.
Figure 12:
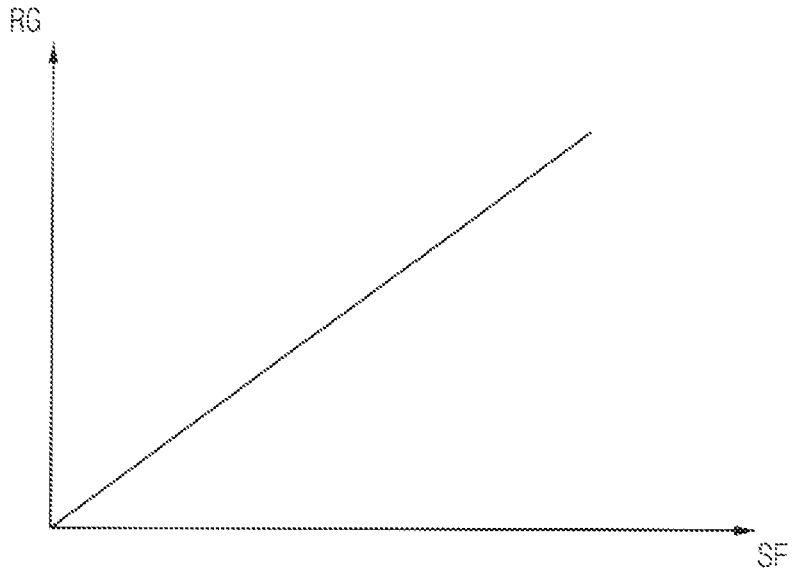
FIG. 12 is a graph illustrating an example of a reference grayscale value according to a scale factor of the display device of FIG. 1.

FIG. 9 is a diagram for explaining a luminance control operation of the display device 1000 of FIG. 1, FIG. 10 is a table of another example of the histogram of the display device 1000 of FIG. 1, FIG. 11 is a graph illustrating another example in which the display device 1000 of FIG. 1 determines whether to perform the sensing operation, and FIG. 12 is a graph illustrating an example of the reference grayscale value RG according to a scale factor SF of the display device of FIG. 1.

Referring to FIGS. 1, 2, and 9 to 12, the display panel driver 10 may selectively perform the luminance control operation for controlling a luminance of the display panel 100 in response to the luminance control signal LCS. The display panel driver 10 may adjust the reference grayscale value RG when the luminance control operation is performed.

The display panel driver 10 may perform the luminance control operation by applying the scale factor SF to the input image data IMG. The scale factor SF may have a value greater than about 0 and less than about 1. For example, when the scale factor SF is 0.5, the display panel driver 10 may apply the scale factor SF of 0.5 to the input image data IMG, so that the luminance of an image displayed based on the input image data IMG may be reduced to half ((0.5)* (luminance when the luminance control operation is not performed)). For example, as shown in FIG. 9, a luminance corresponding to a 20-grayscale value 20G when the luminance control operation is performed may be substantially the same as a luminance corresponding to the 10-grayscale value 10G when the luminance control operation is not performed. For example, a luminance corresponding to a 35-grayscale value 35G when the luminance control operation is performed may be substantially the same as a luminance corresponding to the 20-grayscale value 20G when the luminance control operation is not performed. For example, a luminance corresponding to the 35-grayscale value 35G when the luminance control operation is performed may be substantially the same as a luminance corresponding to the 20-grayscale value 20G when the luminance control operation is not performed. For example, a luminance corresponding to a 220-grayscale value 220G when the luminance control operation is performed may be substantially the same as a luminance corresponding to a 200-grayscale value 200G when the luminance control operation is not performed. Accordingly, when the reference gradation RG is not adjusted, the sensing recognition phenomenon that does not occur when the luminance control operation is not performed may occur even for input image data IMG including the same grayscale values.

The display panel driver 10 may adjust the reference grayscale value RG based on the scale factor SF. The display panel driver 10 may adjust the reference grayscale value RG by increasing the reference grayscale value RG as the scale factor SF increases. FIG. 12 illustrates that the reference grayscale value RG is substantially linearly proportional to the scale factor SF, but embodiments are not limited thereto.

For example, it is assumed that the reference grayscale value RG before adjustment is the 15-grayscale value 15G, a resolution is 3840×2160, ¼ of the input image data IMG includes the 10-grayscale value 10G, ¼ includes the 20-grayscale value 20G, and ½ includes the 200-grayscale value 200G, a luminance of the 20-grayscale value 20G before the luminance control operation is the same as a luminance of a 13-grayscale value after the luminance control operation. Since the resolution is 3840×2160, the total number of the pixels Px is 8,294,400. For example, the number of the pixels Px for displaying the 10-grayscale value 10G is 2,073,600, the number of the pixels Px for displaying the 20-grayscale value 20G is 2,073,600, and the number of the pixels for displaying the 200-grayscale value 200G is 4,147,200. When the reference grayscale value RG is not adjusted, since the pixels Px for displaying grayscale values smaller than or equal to the reference grayscale value RG are included in the hist00, hist01, and hist02 sections, the 10-grayscale value 10G is included in the hist02 section, and a 20-grayscale value is included in the hist03 section, the number of the pixels Px for displaying grayscale values smaller than or equal to the reference grayscale value RG is 2,073,600. The ratio of the number of the grayscale values of the input image data IMG less than or equal to the reference grayscale value RG to the number of all of the grayscale values of the input image data IMG may be calculated by dividing the number of the pixels for displaying the grayscale values smaller than or equal to the reference grayscale value RG by the total number of the pixels Px. Accordingly, the ratio of the number of the grayscale values the input image data IMG less than or equal to the reference grayscale value RG is 2,073,600÷8,294,400=0.25. And, since 0.25 is less than the first reference value RV1, the display panel driver 10 may perform the sensing operation. In this case, when the luminance control operation is performed, since the luminance of the 20-grayscale value 20G is the same as the luminance of the 13-grayscale value after the luminance control operation, the sensing operation may be performed despite the sensing recognition phenomenon. Since the pixels Px for displaying grayscale values smaller than or equal to the reference grayscale value RG are included in the hist00, hist01, hist02, and hist03 sections, the 10-grayscale value 10G is included in the hist02 section, and the 20-grayscale value is included in the hist03 section, the number of the pixels Px for displaying grayscale values smaller than or equal to the reference grayscale value RG is 4,147,200. The ratio of the number of the grayscale values of the input image data IMG less than or equal to the reference grayscale value RG to the number of all of the grayscale values of the input image data IMG may be calculated by dividing the number of the pixels for displaying the grayscale values smaller than or equal to the reference grayscale value RG by the total number of the pixels Px. The ratio of the number of the grayscale values of the input image data IMG less than or equal to the reference grayscale value RG is 4,147,200÷8,294,400=0.5. And, since 0.5 is greater than the first reference value RV1, the display panel driver 10 may not perform the sensing operation. Also, since a luminance change is large as the scale factor SF increases, the display panel driver 10 may adjust the reference grayscale value RG to increase as the scale factor SF increases. Therefore, the display device 1000 may reduce or prevent the sensing recognition phenomenon regardless of the luminance control operation by adjusting the reference grayscale value RG when the luminance control operation is performed.

Figure 13:
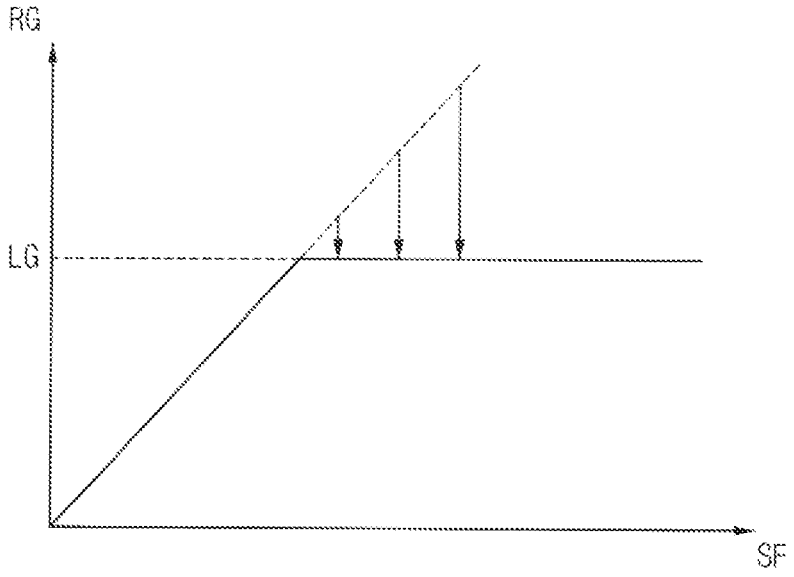
FIG. 13 is a graph illustrating another example of a reference grayscale value according to the scale factor of the display device of FIG. 1.

FIG. 13 is a graph illustrating another example of the reference grayscale value RG according to the scale factor SF of the display device of FIG. 1.

The display device according to this embodiment is substantially the same as the display device 1000 of FIG. 1 except for adjusting the reference grayscale value RG to a threshold grayscale value LG. Thus, the same reference numerals are used to refer to the same or similar element, and any repetitive description is omitted to avoid redundancy.

Referring to FIGS. 1 and 13, the display panel driver 10 may adjust the reference grayscale value RG to the threshold grayscale value LG when the reference grayscale value RG adjusted based on the scale factor SF is greater than the threshold grayscale value LG. When the reference grayscale value RG is very large as the scale factor SF increases, the display panel driver 10 may perform the sensing operation on almost all of the input image data IMG. Accordingly, the display panel driver 10 may stop the sensing operation even when the scale factor SF has a very large value by setting the threshold gradation LG.

Figure 14:
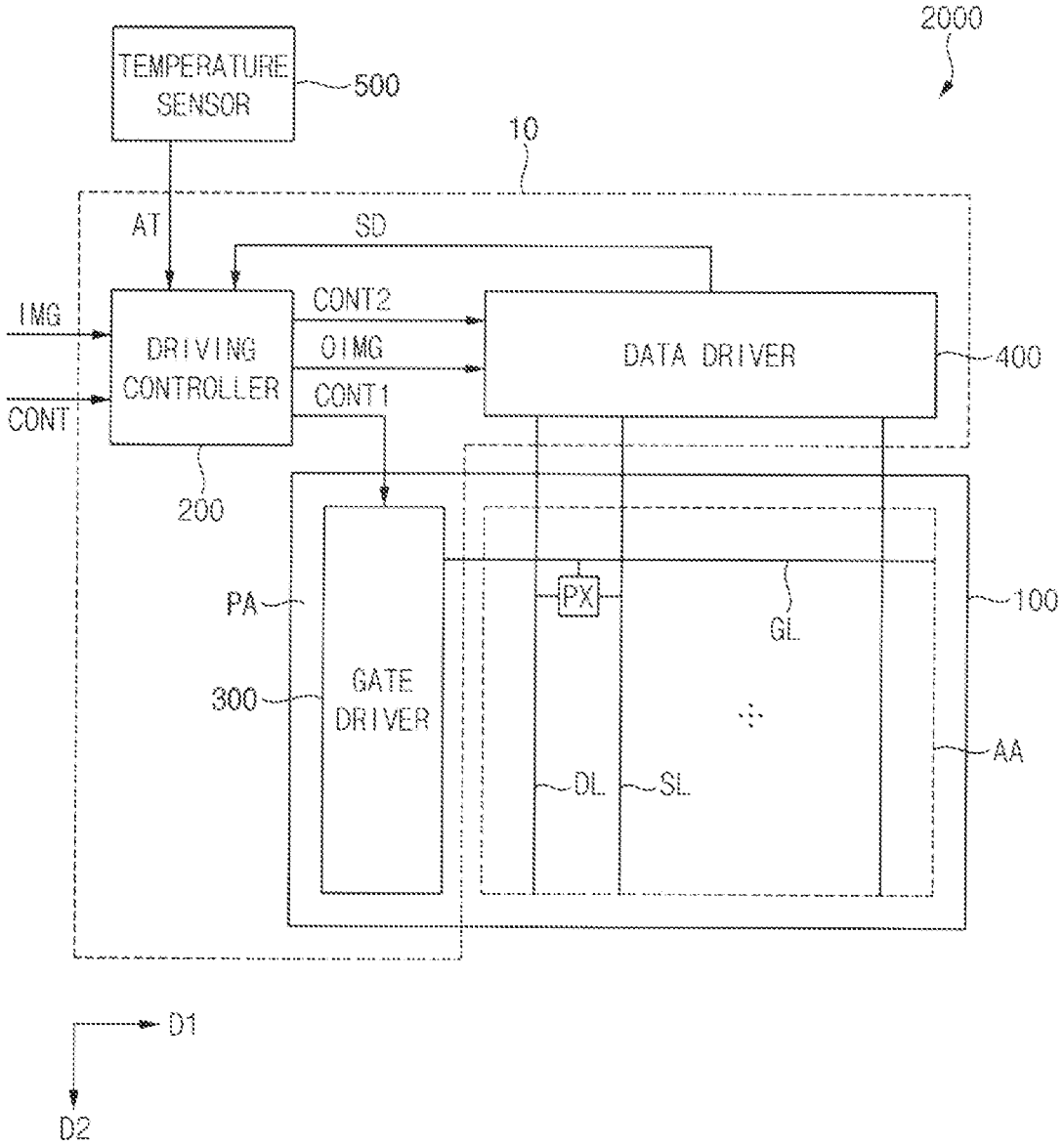
FIG. 14 is a block diagram of another embodiment of the display device constructed according to the principles of the invention.
Figure 15:
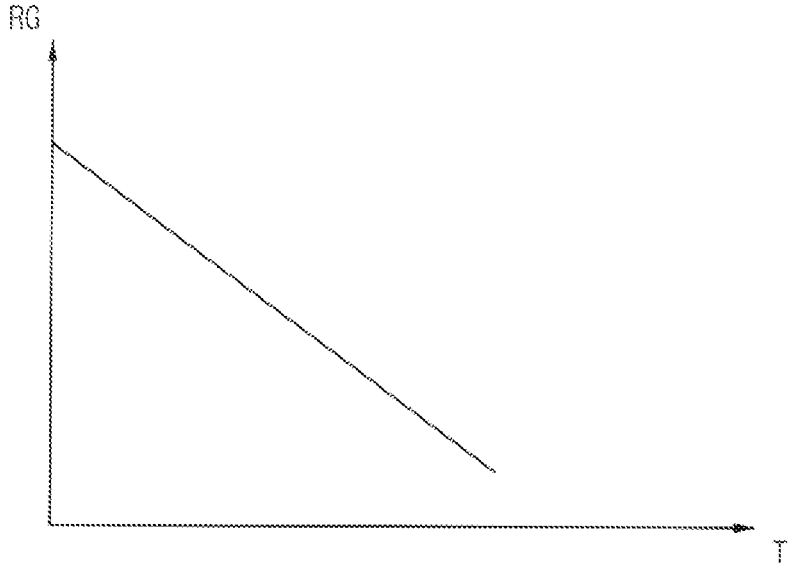
FIG. 15 is a graph illustrating an example of a reference grayscale value according to the temperature of a display panel of the display device of FIG. 14.

FIG. 14 is a block diagram illustrating a display device 2000 according to embodiments, and FIG. 15 is a graph illustrating an example of the reference grayscale value RG according to the temperature T of the display panel 100 of the display device of FIG. 14.

The display device according to this embodiment is substantially the same as the display device 1000 of FIG. 1 except for a temperature sensor 500, adjusting the reference grayscale value RG, and not performing the luminance control operation. Thus, the same reference numerals are used to refer to the same or similar element, and any repetitive description is omitted to avoid redundancy.

Referring to FIGS. 14 and 15, the display device 2000 may include the temperature sensor 500 sensing an ambient temperature AT. The ambient temperature AT may be a temperature T of the display panel 100 when the input image data IMG is black image data (e.g., when the input image data IMG includes only 0 grayscale) and a black image (i.e., an image including only 0 grayscale) is displayed on the display panel 100. The display device 2000 may predict the temperature T of the display panel 100 based on the ambient temperature AT and the input image data IMG. For example, the display device 2000 may calculate a change in the temperature T of the display panel 100 based on the input image data IMG, and predict the temperature T of the display panel 100 by adding the change in amount of the temperature T of the display panel 100 to the ambient temperature AT.

The display panel driver 10 may adjust the reference grayscale value RG based on the temperature of the display panel 100. The display panel driver 10 may adjust the reference grayscale value RG by decreasing the reference grayscale value RG as the temperature T of the display panel 100 increases. FIG. 15 illustrates that the reference grayscale value RG is inversely proportional to the temperature T of the display panel 100, but embodiments are not limited thereto. The luminance of the same grayscale value may vary according to the temperature T of the display panel 100. For example, when the temperature T of the display panel 100 increases, the luminance of an image of the same grayscale value may be greater than before the temperature T of the display panel 100 increases. Therefore, the sensing recognition phenomenon that did not occur before the temperature T of the display panel 100 rises may occur after the temperature T of the display panel 100 rises even with the input image data IMG including the same grayscale values. Therefore, the display device 2000 may reduce or prevent the sensing recognition phenomenon regardless of the temperature T of the display panel 100 by adjusting the reference grayscale value RG according to the temperature T of the display panel 100.

Figure 16:
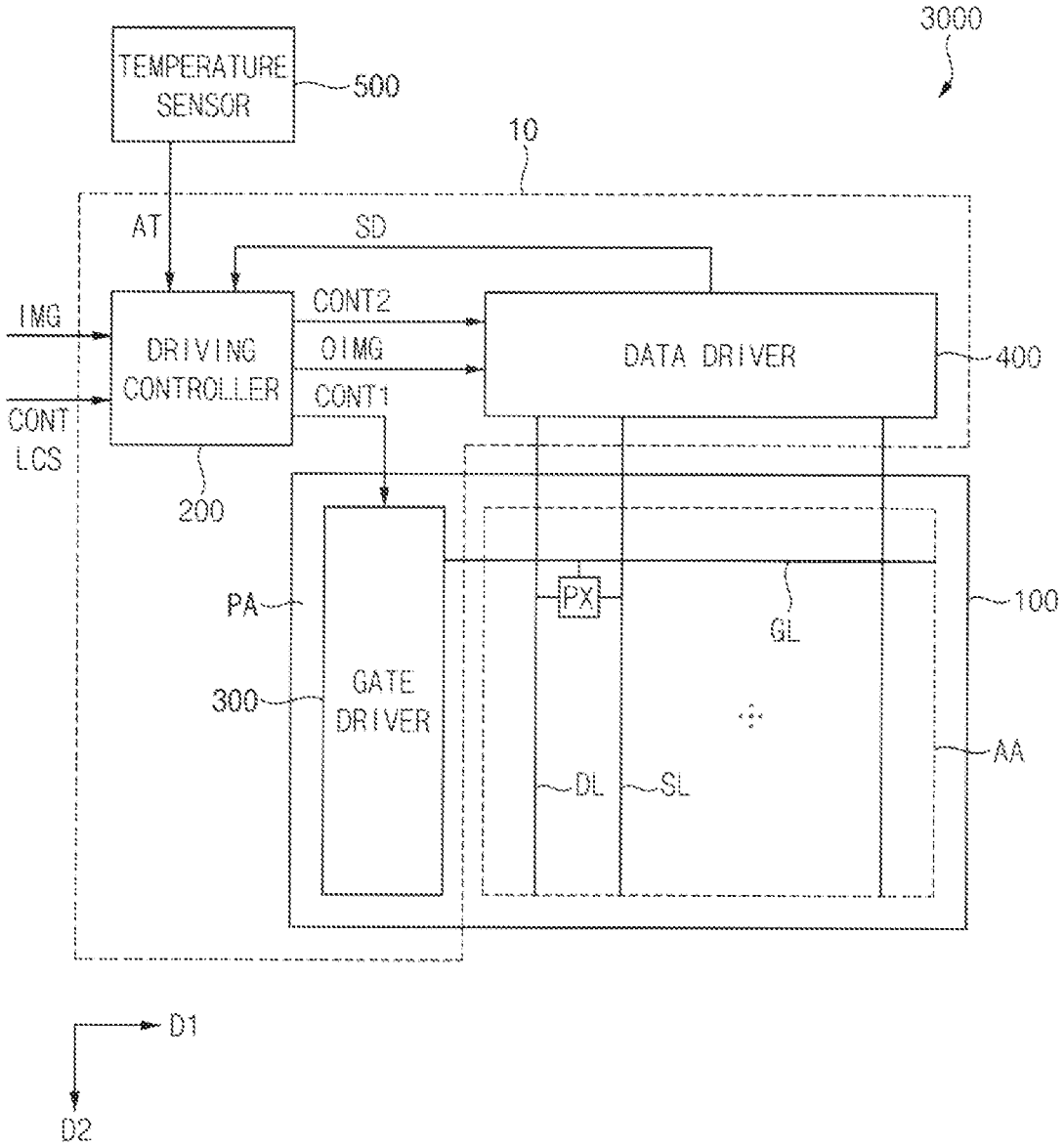
FIG. 16 is a block diagram of another embodiment of the display device constructed according to the principles of the invention.

FIG. 16 is a block diagram of another embodiment of the display device 3000 constructed according to the principles of the invention.

The display device according to this embodiment is substantially the same as the display device 3000 of FIG. 1 except for a temperature sensor 500, and adjusting the reference grayscale value RG. Thus, the same reference numerals are used to refer to the same or similar element, and any repetitive description is omitted to avoid redundancy.

Referring to FIGS. 15 and 16, the display device 2000 may include the temperature sensor 500 sensing an ambient temperature AT. The ambient temperature AT may be a temperature T of the display panel 100 when the input image data IMG is the black image data and the black image is displayed on the display panel 100. The display device 2000 may predict the temperature T of the display panel 100 based on the ambient temperature AT and the input image data IMG. For example, the display device 2000 may calculate a change in the temperature T of the display panel 100 based on the input image data IMG, and predict the temperature T of the display panel 100 by adding the change in amount of the temperature T of the display panel 100 to the ambient temperature AT.

The display panel driver 10 may adjust the reference grayscale value RG based on the temperature of the display panel 100. The display panel driver 10 may adjust the reference grayscale value RG by decreasing the reference grayscale value RG as the temperature T of the display panel 100 increases and may adjust the reference grayscale value RG by increasing the reference grayscale value RG as the scale factor SF increases. The sensing recognition phenomenon that did not occur before the temperature T of the display panel 100 rises may occur after the temperature T of the display panel 100 rises even with the input image data IMG including the same grayscale values. Therefore, the display device 2000 may reduce or prevent the sensing recognition phenomenon regardless of the temperature T of the display panel 100 by adjusting the reference grayscale value RG according to the temperature T of the display panel 100. When the reference gradation RG is not adjusted, the sensing recognition phenomenon that does not occur when the luminance control operation is not performed may occur even for input image data IMG including the same grayscale values. The display device 1000 may reduce or prevent the sensing recognition phenomenon regardless of the luminance control operation by adjusting the reference grayscale value RG when the luminance control operation is performed.

Figure 17:
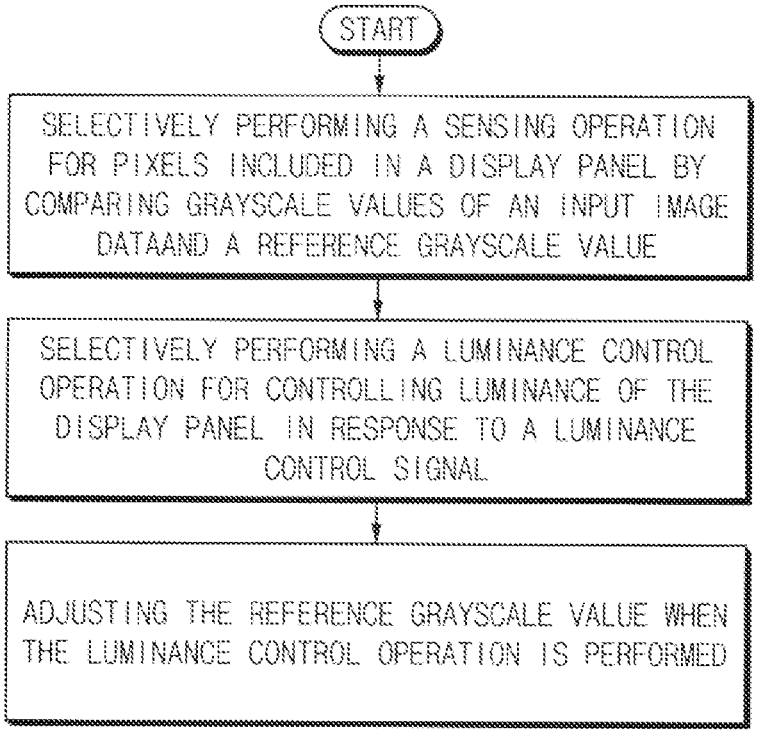
FIG. 17 is a flowchart of an embodiment of a method of driving a display device constructed according to the principles of the invention.

FIG. 17 is a flowchart of an embodiment of a method of driving a display device according to the principles of the invention.

Referring to FIGS. 17, the method of FIG. 17 may include selectively performing a sensing operation for pixels included in a display panel by comparing grayscale values of an input image data and a reference grayscale value (S100), selectively performing a luminance control operation for controlling luminance of the display panel in response to a luminance control signal (S200), and adjusting the reference grayscale value when the luminance control operation is performed (S300). Since these features are described above, repetitive description thereof thereto will omitted to avoid redundancy.

The embodiments may be applied to any electronic device including the display device. For example, the embodiments may be applied to a television (TV), a digital TV, a 3D TV, a mobile phone, a smart phone, a tablet computer, a virtual reality (VR) device, a wearable electronic device, a personal computer (PC), a home appliance, a laptop computer, a personal digital assistant (PDA), a portable multimedia player (PMP), a digital camera, a music player, a portable game console, a navigation device, etc.

Although certain embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device comprising:

a display panel including pixels; and a driver to drive the display panel based on input image data, to selectively perform a sensing operation for the pixels by comparing grayscale values of the input image data and a reference grayscale value, to selectively perform a luminance control operation for controlling luminance of the display panel in response to a luminance control signal, and to adjust the reference grayscale value when the luminance control operation is performed, wherein the driver is configured to generate a histogram of the grayscale values of the input image data, and to compare the grayscale values of the input image data and the reference grayscale value based on the histogram.

2. The display device of claim 1, wherein the driver performs the sensing operation by generating sensing data corresponding to a driving current of a driving transistor of each of the pixels in a vertical blank period.

3. The display device of claim 1, wherein the driver does not perform the sensing operation when a ratio of a number of the grayscale values of the input image data less than or equal to the reference grayscale value to a number of all of the grayscale values of the input image data is greater than or equal to a first reference value.

4. The display device of claim 1, wherein the driver does not perform the sensing operation when a ratio of a number of the grayscale values of the input image data less than or equal to the reference grayscale value to a number of all of the grayscale values of the input image data is greater than or equal to a first reference value and is less than or equal to a second reference value greater than the first reference value.

5. The display device of claim 1, wherein the driver does not perform the sensing operation when a ratio of a number of the grayscale values of the input image data less than or equal to the reference grayscale value except for a 0-grayscale value to a number of all of the grayscale values of the input image data is greater than or equal to a first reference value.

6. The display device of claim 1, wherein the driver does not perform the sensing operation when a ratio of a number of the grayscale values of the input image data less than or equal to the reference grayscale value except for a 0-grayscale value to a number of all of the grayscale values of the input image data is greater than or equal to a first reference value and is less than or equal to a second reference value greater than the first reference value.

7. The display device of claim 1, wherein the pixels comprise red pixels, blue pixels, and green pixels, wherein the driver does not perform the sensing operation when a ratio of a number of the grayscale values of the input image data for the red pixels less than or equal to the reference grayscale value to a number of all of the grayscale values of the input image data for the red pixels is greater than or equal to a first reference value, wherein the driver does not perform the sensing operation when a ratio of a number of the grayscale values of the input image data for the blue pixels less than or equal to the reference grayscale value to a number of all of the grayscale values of the input image data for the blue pixels is greater than or equal to the first reference value, and wherein the driver does not perform the sensing operation when a ratio of a number of the grayscale values of the input image data for the green pixels less than or equal to the reference grayscale value to a number of all of the grayscale values of the input image data for the green pixels is greater than or equal to the first reference value.

8. The display device of claim 1, wherein the driver is configured to perform the luminance control operation by applying a scale factor to the input image data.

9. The display device of claim 8, wherein the driver is configured to adjust the reference grayscale value based on the scale factor.

10. The display device of claim 9, wherein the scale factor is greater than about 0 and less than about 1, and wherein the driver is configured to adjust the reference grayscale value by increasing the reference grayscale value as the scale factor increases.

11. The display device of claim 9, wherein the driver is configured to adjust the reference grayscale value to a threshold grayscale value when the reference grayscale value adjusted based on the scale factor is greater than the threshold grayscale value.

12. A display device comprising:

a display panel including pixels; and a driver to drive the display panel based on input image data, to selectively perform a sensing operation by comparing grayscale values of the input image data and a reference grayscale value, and to adjust the reference grayscale value based on a temperature of the display panel, wherein the driver is configured to generate a histogram of the grayscale values of the input image data, and to compare the grayscale values of the input image data and the reference grayscale value based on the histogram.

13. The display device of claim 12, wherein the driver is configured to adjust the reference grayscale value by decreasing the reference grayscale value as the temperature of the display panel increases.

14. The display device of claim 12, wherein the driver does not perform the sensing operation when a ratio of a number of the grayscale values of the input image data less than or equal to the reference grayscale value to a number of all of the grayscale values of the input image data is greater than or equal to a first reference value.

15. The display device of claim 12, wherein the driver is configured to generate a histogram of the grayscale values of the input image data, and to compare the grayscale values of the input image data and the reference grayscale value based on the histogram.

16. The display device of claim 12, wherein the driver is configured to selectively perform a luminance control operation for controlling luminance of the display panel in response to a luminance control signal, and to adjust the reference grayscale value when the luminance control operation is performed.

17. The display device of claim 16, wherein the driver is configured to perform the luminance control operation by applying a scale factor to the input image data.

18. The display device of claim 17, wherein the driver is configured to adjust the reference grayscale value based on the scale factor.

19. The display device of claim 18, wherein the scale factor is greater than about 0 and less than about 1, and wherein the driver is configured to adjust the reference grayscale value by increasing the reference grayscale value as the scale factor increases.

20. A method of driving a display device, comprising:

selectively performing a sensing operation for pixels included in a display panel by comparing grayscale values of an input image data and a reference grayscale value;

selectively performing a luminance control operation for controlling luminance of the display panel in response to a luminance control signal;

adjusting the reference grayscale value when the luminance control operation is performed;

generating a histogram of the grayscale values of the input image data, and comparing the grayscale values of the input image data and the reference grayscale value based on the histogram.

* * * * *